US006332298B1

(12) United States Patent
Bigelow

(10) Patent No.: US 6,332,298 B1
(45) Date of Patent: Dec. 25, 2001

(54) PORTABLE BUILDING CONSTRUCTION

(76) Inventor: William H. Bigelow, P.O. Box 7064, Houston, TX (US) 77248

( * ) Notice: Subject to any disclaimer, the term of this patent is extended or adjusted under 35 U.S.C. 154(b) by 0 days.

(21) Appl. No.: 09/565,113

(22) Filed: May 4, 2000

Related U.S. Application Data

(63) Continuation-in-part of application No. 09/280,455, filed on Mar. 30, 1999, now Pat. No. 6,085,470, which is a continuation-in-part of application No. 09/276,895, filed on Mar. 25, 1999, which is a continuation-in-part of application No. 09/033,968, filed on Mar. 3, 1998, now Pat. No. 6,088,969, which is a continuation-in-part of application No. 08/887,167, filed on Jul. 2, 1997, now Pat. No. 5,864,992.

(51) Int. Cl.[7] ..... E04H 12/00

(52) U.S. Cl. ..... 52/648.1; 52/243; 52/236.3; 52/236.6; 52/236.7; 52/79.9; 52/79.1; 52/125.2

(58) Field of Search ..... 52/143, 243, 236.3, 52/236.6, 236.7, 95, 79.1, 79.9, 79.13, 302.3, 125.1, 125.2, 653.1, 648.1

(56) References Cited

U.S. PATENT DOCUMENTS

| | | | |
|---|---|---|---|
| 758,033 | 4/1904 | Holmes . | |
| 4,274,234 | 6/1981 | Abell . | |
| 4,364,206 | 12/1982 | Wybauw . | |
| 4,470,227 | 9/1984 | Bigelow, Jr. et al. . | |
| 4,637,179 | 1/1987 | Bigelow, Jr. et al. . | |
| 4,901,484 | 2/1990 | Santosvosso . | |
| 5,193,325 | 3/1993 | Allison . | |
| 5,317,857 | 6/1994 | Allison . | |
| 5,349,793 | 9/1994 | Bigelow, Jr. . | |
| 5,403,055 | 4/1995 | Allison . | |
| 5,634,315 | 6/1997 | Toya . | |
| 5,642,594 | 7/1997 | Sucre . | |
| 5,653,459 | 8/1997 | Murphy . | |
| 5,660,005 | 8/1997 | Tacoma . | |
| 5,678,715 | * 10/1997 | Sjostedt et al. | 220/1.5 |
| 5,864,992 | 2/1999 | Bigelow . | |

OTHER PUBLICATIONS

Standardizing End Frames Gives Exporters Passport To More Markets, Automated Builder, Sep. 95, pp. 26 and 28.

* cited by examiner

*Primary Examiner*—Carl D. Friedman
*Assistant Examiner*—Dennis L. Dorsey
(74) *Attorney, Agent, or Firm*—Guy McClung

(57) ABSTRACT

A beam structure, the beam having a body with two spaced-apart ends, two blocks in the body, each optionally with at least one lifting eye, each of the two blocks spaced-apart from each other and spaced-apart from the two spaced-apart ends of the body; and a structure with a first beam and a second beam, each beam comprising a body with two spaced-apart ends, two blocks in the body, in one aspect of the size of standard ISO corner fittings, each of the two blocks spaced-apart from each other and spaced-apart from the two spaced-apart ends of the body, each beam having a tubular support on and projecting from each block, the tubular supports aligned as two pairs of tubular supports, two tubular members one each extending between each pair of the tubular supports, each tubular member having two ends with one end projecting into one of the tubular supports of a pair of tubular supports and one end projecting into the other tubular support of the pair of tubular supports.

19 Claims, 14 Drawing Sheets

Fig. 2A
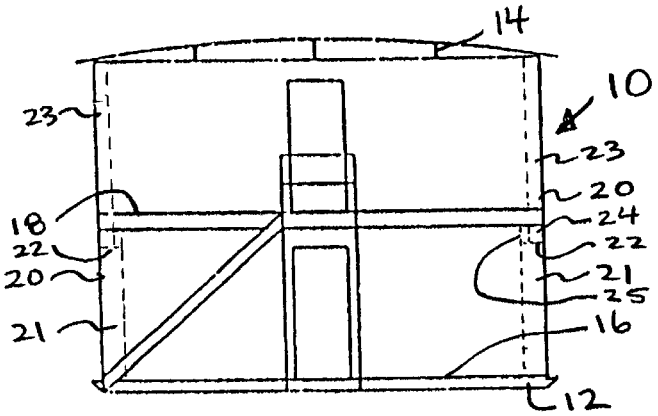
Fig. 2C
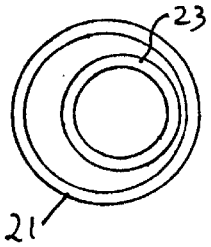
Fig. 2D
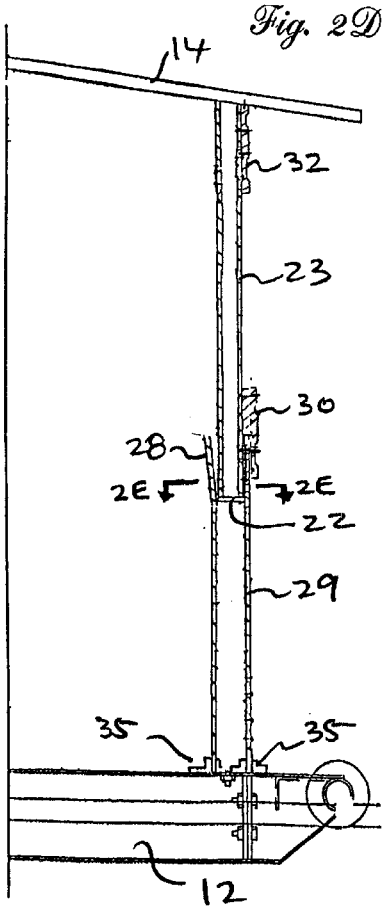
Fig. 2B
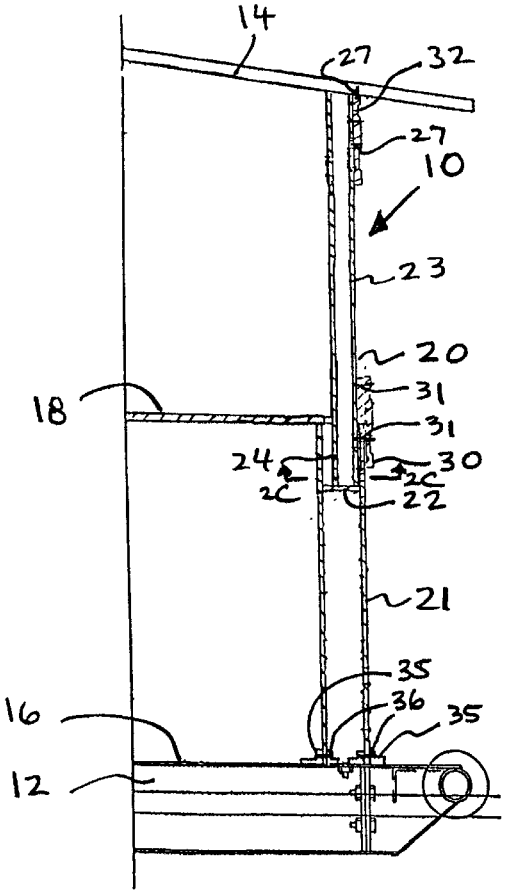
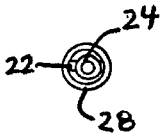
Fig. 2E

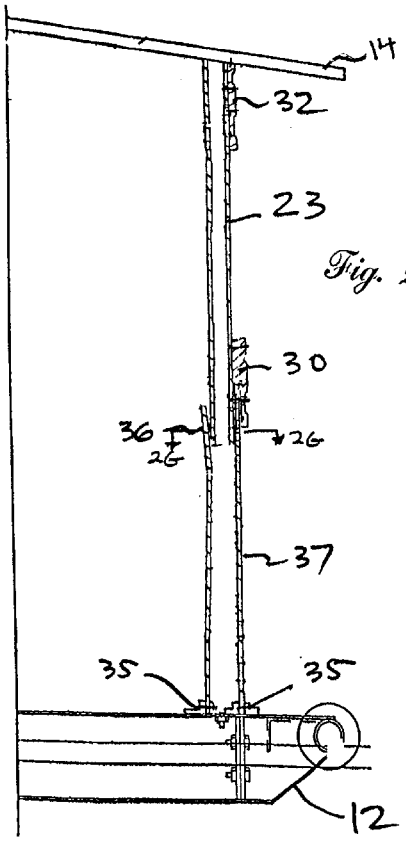
Fig. 2F
Fig. 2G
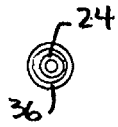
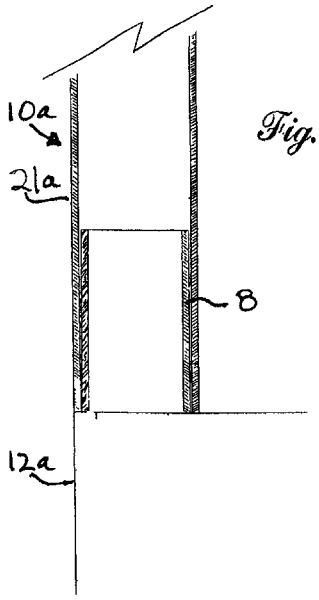
Fig. 2H
Fig. 3A
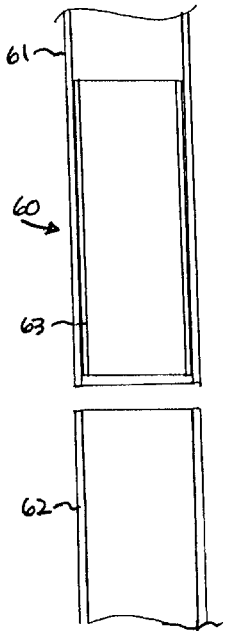
Fig. 3B
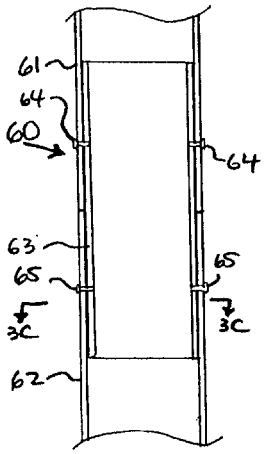
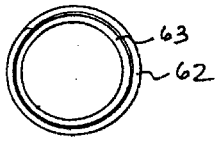
Fig. 3C Fig. 7A
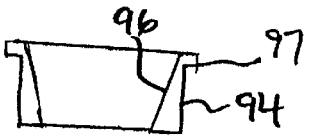
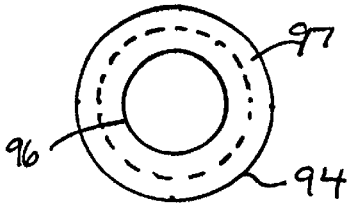
Fig. 7B
Fig. 8A
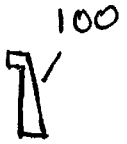
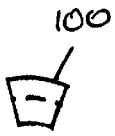
Fig. 8B
Fig. 9A
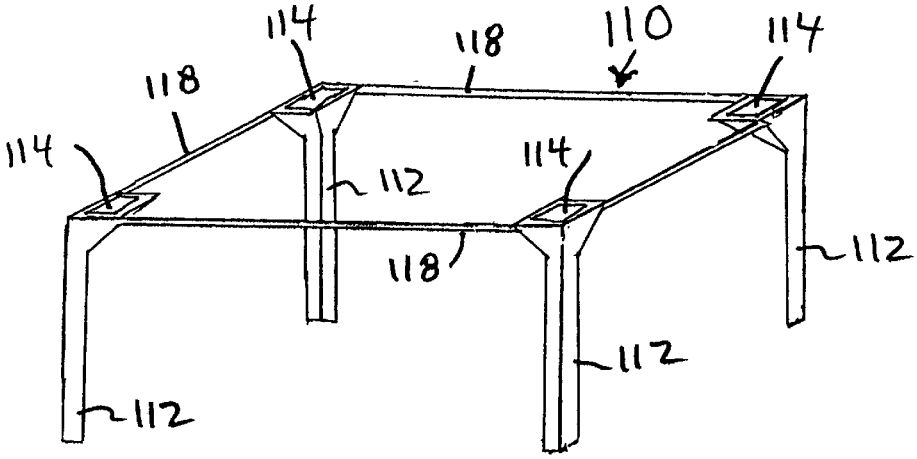
Fig. 9B
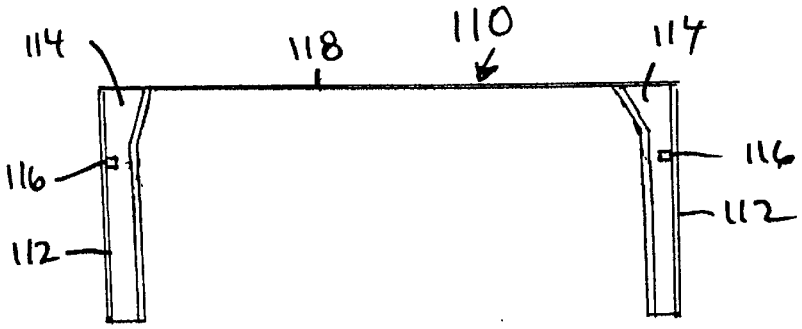

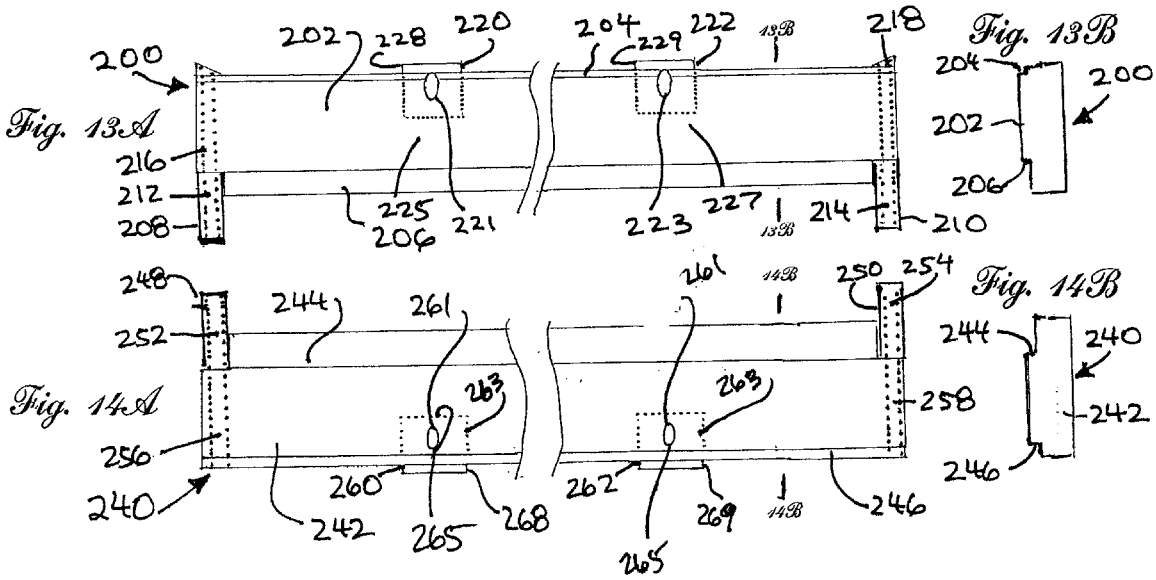
Fig. 13A
Fig. 13B
Fig. 14A
Fig. 14B
200
202
204
206
208
210
212
214
216
218
220
221
222
223
225
227
228
229
240
242
244
246
248
250
252
254
256
258
260
261
262
263
264
265
268
269
13B
14B
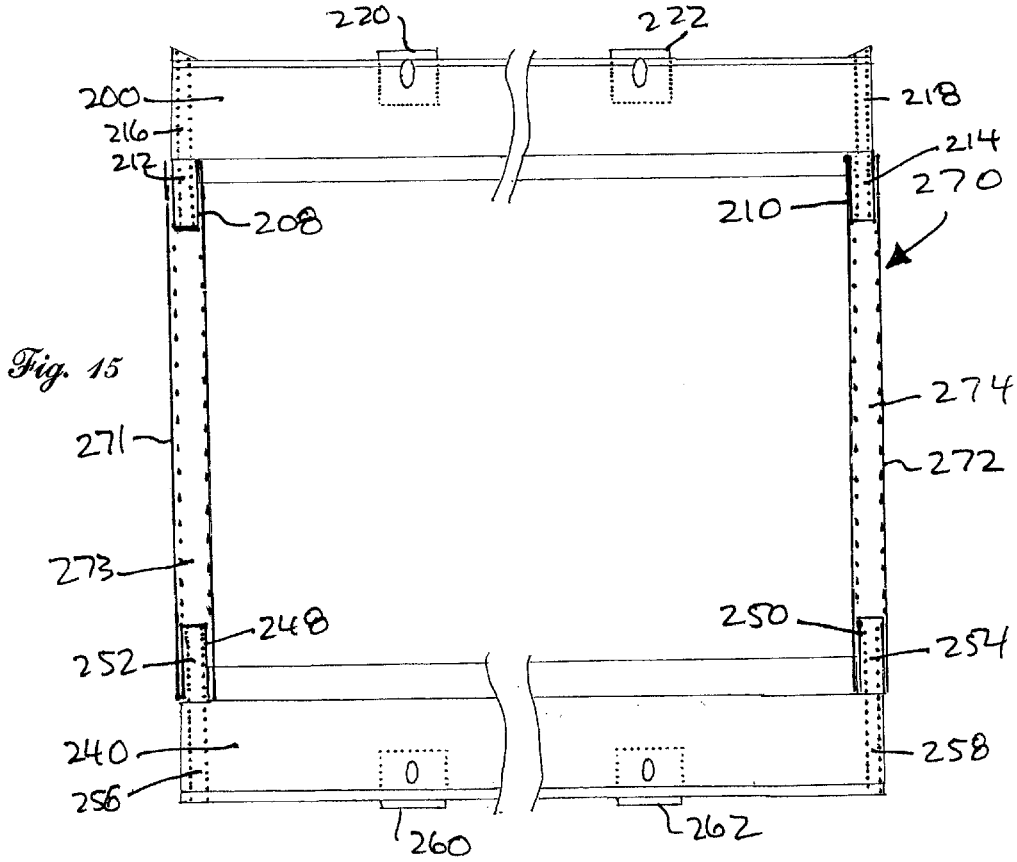
Fig. 15
200
208
210
212
214
216
218
220
222
240
248
250
252
254
256
258
260
262
270
271
272
273
274

PORTABLE BUILDING CONSTRUCTION

RELATED APPLICATION

This is a continuation-in-part of U.S. application Ser. No. 09/276,895 filed Mar. 25, 1999 which is incorporated fully herein for all purposes. This is a continuation-in-part of U.S. application Ser. No. 09/280,455 filed Mar. 30, 1999, now U.S. Pat. No. 6,085,470, which is a continuation-in-part of U.S. application Ser. No. 09/033,968, filed on Mar. 3, 1998 entitled "Roof and Portable Building,", now U.S. Pat. No. 6,088,969 which is a continuation-in-part of U.S. application Ser. No. 08/887,167 filed Jul. 2, 1997 entitled "Roof And Portable Building" issued as U.S. Pat. No. 5,864,992 on Feb. 2, 1999, all co-owned with the present invention, all applications and patents incorporated fully herein for all purposes.

BACKGROUND OF THE INVENTION

1. Field of the Invention

This invention is directed to building construction, modular buildings, portable buildings, a building module, and apparatus and methods for facilitating the correct alignment, connection, and stabilization of one building structure on another.

2. Description of Related Art

The prior art discloses a variety of structures and methods for mounting an upper structure (another building, additional story of a building, roof structure, upper deck, etc.) on a lower or base structure. In one prior art system a second story module is emplaced on a first story module and corner beams or braces and/or intermediate members are secured to each story.

As shown in FIG. 1A a prior art system as disclosed in U.S. Pat. No. 4,470,227 discloses structure and methods for stacking one building core on another which are interconnected and secured together with metal angle members at their corners. The angle members serve as guides and supports and hold the cores in stacked condition during shipping.

U.S. Pat. No. 4,364,206 discloses a prior art system with stackable prefabricated building units having vertical corner casings extending into corner openings of a top wall. Bolts through an angle member and the top wall join the vertical casings to the top wall. Bolts through an adjacent unit and support beams join the adjacent unit to the top wall of a lower unit. In another aspect pieces of adjacent units are welded together. In another aspect attached sheet metal panels join together a series of units.

FIG. 1B shows a prior art two-story building on a skid with a floor and upper and lower walls which are interconnected by connection members through which extend bolts or screws into each wall. A ceiling/second story floor is supported by the lower wall. The upper wall's interior side rests on the ceiling/second story floor.

Another common prior art system is the well known use of standard ISO containers and the stacking of such containers one on top of the other. Certain of these prior art systems have a relatively large footprint in use and in transport.

SUMMARY OF THE PRESENT INVENTION

The present invention, in certain aspects discloses a portable building system and method for its transport and assembly. In certain aspects upper and lower beams or "headers" at spaced-apart ends of the building have as an integral part thereof a block in the same shape, size, and configuration as the well-known widely-used standard ISO ("International Standards Organization") fittings blocks or corners with a plurality of lifting eyes used in the shipping and transport industries worldwide at the corners of standard ISO shipping containers.

In certain aspects these blocks are not at the corners of the beams or headers, but are incorporated within the beam or header at an intermediate location. Thus, a portable building with such blocks is not limited in dimensions to the size of the standard ISO shipping container in which the ISO fittings are at the outermost corners of the container.

In certain aspects, such portable buildings have a roof with support members having a hollow inner body and an upper exposed opening which can receive moisture and rain water from the roof. This water flows into the support, which is an integral part of the assembled building, and then from within the support to the interior of other hollow building components which channel it to a collection container and/or to the ground adjacent the building.

In certain aspects such a building is assembled by bolting the various components together without the need for welding parts together (although it is within the scope of other aspects of this invention to weld any metal parts together as desired).

In certain aspects, the floor, the walls, the headers, the beams, the components, and/or the roof (and/or any interior and/or exterior surface of the building) are coated with covering material as described below.

The present invention, in certain embodiments, discloses a multi-story building or a building with a lower structure and an upper structure wherein the first floor or lower structure has at least one wall (or upright support, pillar, pole, or beam) with at least an upper enlarged portion which is sized to receive and hold a lower portion of an upper wall (or upper beam, pillar, pole support). In one aspect the entire length of the wall of the first floor or lower structure is enlarged and the upper wall's or upper support's lower portion is bolted to and within the lower wall and/or rests on one or more steps in the lower wall.

As desired, the upper and lower walls may be further secured together with interconnecting members, ribs, panels, braces, beams, etc. The upper wall may be a wall of an upper story or a support for an upper structure such as a truss or roof. Each lower wall may have an enlarged portion along its entire length; e.g. in a square or rectangular building all four lower walls may have the upper enlarged portion and all upper walls along their entire length may fit into the enlarged portions of the lower walls.

In another aspect, the lower structure initially includes no walls, but has at least one pillar (beam, support, pole, etc.) with an enlarged open upper end which receives and holds a smaller end of an upper pillar (beam, support, pole, etc.). In one aspect the lower structure includes four such lower pillars each with an enlarged or "funnel" upper opening for facilitating the reception into the lower pillars of a lower end of each of four upper pillars. Of course, any suitable number of structures, building units, pillars, etc. may be stacked and interconnected one on top of the other.

In one aspect the lower wall or lower pillar has a top funnel or enlarged portion which is sized so that the lower end of an upper wall or upper pillar fits in it and is held therein by a friction fit, with or without the use of a stop member or members in the lower wall or pillar on which rests the lower end of the upper wall or upper pillar. Any suitable stop member or members may be used; e.g. a bolt or bolts extending into the lower structure; a plate, strip, or strips secured across the interior of the lower structure; an amount of material glued to the interior of the lower structure; a plug, hollow or solid secured in the lower structure; or a cylindrical or semi-cylindrical member secured in a cylindrical pillar. Bolts, screws, glue, or other fasteners may be used through any upper and lower structure or members herein at an area of their overlap to secure them together.

In one aspect the present invention discloses a structure as described above with a lower pillar having at least a top portion which is hollow (and which in one embodiment may be hollow along its entire length) and an upper pillar similarly hollow. A connection member (solid or hollow) that fits within both pillars is disposed with a portion in both pillars and secured to both pillars, e.g. with glue, screws and or bolts. If the pillars are cylindrical, the connection member may be cylindrical, semi-cylindrical, or some portion of a cylinder. Such a connection member facilitates correcting positioning of an upper pillar with respect to a lower pillar. In one aspect the connection member is emplaced within the upper pillar; the upper pillar is moved over the lower pillar; and the connection member is lowered so that part of it extends into the lower pillar. Alternatively the connection member is originally disposed in the lower pillar and it is raised partially so its upper end extends into the upper pillar. In one aspect one or more stops are positioned in the lower pillar to support and position the connection member. In another aspect one or more spring-loaded detents initially holds the connection member in one of the pillars and then holds it in the other. In one aspect two spaced apart detents are used, one holding the connection member to a lower pillar and one holding it to an upper member.

In one embodiment, the present invention discloses a lower pillar with an upper funnel portion which is sized, configured and positioned for receiving a tapered lower nose of a connection member (solid or hollow) originally movably disposed in an upper pillar. The nose may be held in the funnel portion with a friction fit, glue, screws, and/or bolts. The funnel portion may be formed integrally of the lower pillar or it may be a separate piece or pieces disposed on and/or in the upper part of the lower pillar. The funnel portion may be made of the same material as the lower pillar (metal, wood, plastic, fiberglass) or of different material. In one aspect the funnel portion may have an upper lip or upper portion that serves as a shock absorber and/or seal or gasket between an upper and a lower pillar.

Any building unit or structure disclosed herein may be mounted on a skid, frame, truck, or trailer.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

- New, useful, unique, efficient, nonobvious portable buildings, portable building kits, and methods for transporting and assembling them;
- Such buildings with components having integral blocks that correspond to standard ISO shipping container corners; and
- Such building which can be assembled solely with bolted-together major components;
- New, useful, unique, efficient, nonobvious devices and methods for building units, interconnected supports including walls and pillars, methods to facilitate emplacement and positioning of an upper unit or pillar on a lower unit or pillar, and pillars (or walls) with upper enlarged portions to facilitate reception therein of an upper member.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 2A is an end view of a multi-story building according to the present invention.

FIG. 2B is a partial cross-section view of the building of FIG. 2A.

FIG. 2C is a cross-section view along line 2C—2C of FIG. 2B.

FIG. 2D is a cross-section view along line 2C—2C of FIG. 2C.

FIG. 2E is a bottom cross-section view along line 2E—2E of FIG. 2D.

FIG. 2F is a partial cross-section end view of a system according to the present invention usable in the building of FIG. 2A or other buildings.

FIG. 2G is a bottom cross section view along line 2G—2G of FIG. 2F.

FIG. 2H is a partial side cross-section view of a building and skid mount according to the present invention.

FIG. 3A and 3B are front cross-section views of component connection systems according to the present invention.

FIG. 3C is a cross-section view along line 3C—3C of FIG. 3B.

FIG. 7A is a side view in cross-section of the funnel portion of the lower pillar of the connection system of FIG. 6A.

FIG. 7B is a top view of the funnel portion of FIG. 7A.

FIG. 8A is a side view in cross-section of a funnel member according to the present invention.

FIG. 8B is a top view of the funnel member of FIG. 8A.

FIG. 9A is a perspective view of a multi-pillar building structure according to the present invention.

FIG. 9B is an end view in cross-section of the structure of FIG. 9A.

FIG. 13A is a front view of a beam according to the present invention.

FIG. 13B is a cross-section view along line 13B—13B of FIG. 13A.

FIG. 14A is a front view of a beam according to the present invention.

FIG. 14B is a cross-section view along line 14B—14B of FIG. 14A.

FIG. 15 is a front view of building components for a building according to the present invention.

DESCRIPTION OF EMBODIMENTS PREFERRED AT THE TIME OF FILING FOR THIS PATENT

Figure 1A:
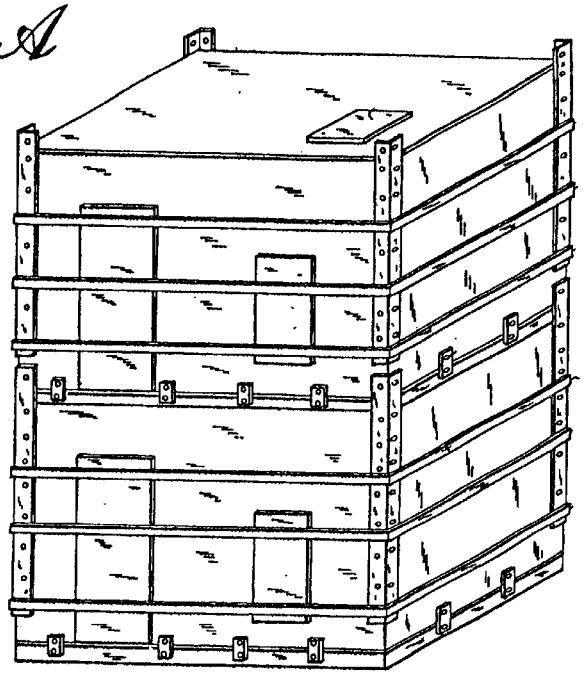
Fig. 1A PRIOR ART
FIG. 1A and 1B show prior art systems.
Figure 1B:
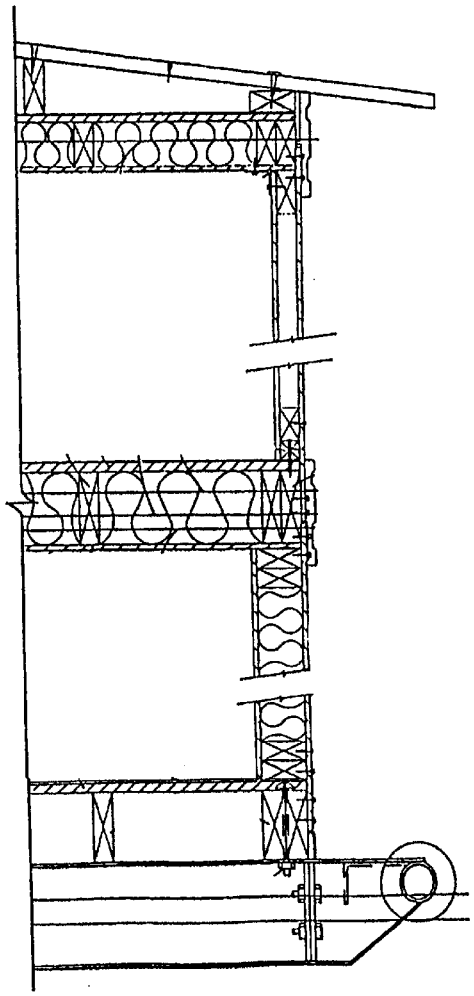
Fig. 1B PRIOR ART

FIGS. 2A–2C shows an end of a rectangular building 10 (with an opposite end, not shown; the ends spaced apart by two opposed sides, not shown—e.g. but not limited to a building as in FIG. 2, U.S. Pat. No. 5,491,934) on a skid 12, the building 10 having four pillar supports 20, one in each corner of the building. The building 10 has a truss roof 14, a lower floor 16 (which may be a floor of the skid 12) and an intermediate floor 18.

Each pillar support 20 has a lower pillar 21 with a stop member 22 secured therein and an upper pillar 23 with a lower end 24 within an upper end 25 of the lower pillar 21. The upper pillar 23 rests on the stop member 22. A brace 30 spans the upper and lower pillars and connectors 31 (fasteners, bolts, screws, dowels, etc.) extend through the brace 30 into the pillars. A brace 32 is connected to a top end of the upper pillar 23 and to the roof 14 by connectors 27. The floor 18 rests on the lower pillar 21 and abuts the upper pillar 23. Mounting brackets 35 with bolts 36 extending through the lower pillar 21 mount it to the skid 12. A plurality of two, three, four or more braces 30 and/or 32 may be used with the building of FIG. 2F or with any building or structure disclosed hereon. FIG. 2H shows an alternative skid mounting structure according to the present invention in which a hollow pillar 21*a* of a building 10*a* (like the building 10) is positioned around a hollow member 8 secured to a skid 12*a*. One or more optional removable pins or bolts 7 may be used to secure the pillar 21*a* to the hollow member 8. This same structure may be used to mount any building disclosed herein on a floor or foundation.

FIGS. 2D–2E show a pillar system 40 according to the present invention with some parts like those of the system of FIG. 2A; and like numerals indicate the same parts. In the system 40 a lower pillar 20 has an upper enlarged portion 28 which receives the lower end 24 of the upper pillar 23.

FIGS. 2F–2G show a pillar system 50 according to the present invention which is like the system of FIG. 2D but which uses a friction fit of the lower end 24 of the upper pillar 23 in an enlarged portion 36 of a lower pillar 37 rather than a stop member. Of course it is within the scope of this invention to use both such a friction fit and stop member.

FIGS. 3A–3C show a pillar connection system 60 for connecting an upper pillar 61 and a lower pillar 62 which are used as the pillars in the systems described above. A connection member 63, in this case in the form of a hollow cylindrical sleeve, may initially reside in either pillar or it may be emplaced therein prior to use. As shown in FIG. 3B, the connection member 63 has an upper end within the upper pillar 61 and a lower end within the lower pillar 62. Bolts 64 releasably secure the connection member to the upper pillar 61 and bolts 65 releasably secure the connection member 63 to the lower pillar 62.

Figure 4A:
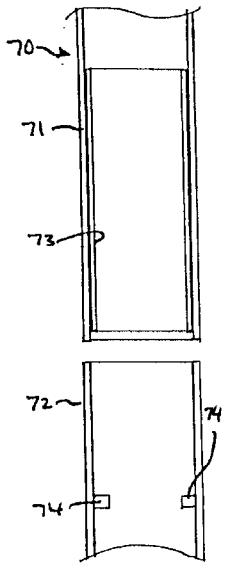
FIG. 4A and 4B are front cross-section views of component connection systems according to the present invention.
Figure 4B:
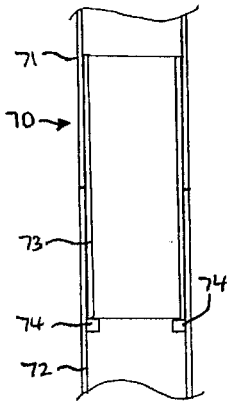

FIGS. 4A and 4B show a pillar system 70 according to the present invention (usable with any building or structure disclosed herein) with an upper pillar 71 and a lower pillar 72 which are hollow cylinders as are the pillars in FIG. 3A (but which may be, as may be any pillar herein, any desired shape as viewed from above, including, but not limited to, oval, square, rectangular, triangular, or polygonal). A connecting sleeve 73 (like the connecting member 63) is initially disposed either in a lower end of the upper pillar 71 (as shown in FIG. 4A) or in an upper end of the lower pillar 72 (not shown). Upon assembly, the connecting sleeve 73 has a lower end that rests on stop members 74 secured to or formed integrally of the lower pillar 72. Alternatively, the connecting sleeve 73 may initially be placed and/or secured in either pillar in the position shown in FIG. 4B, e.g. with glue, screws, bolts, or other fasteners or connectors.

Figure 5A:
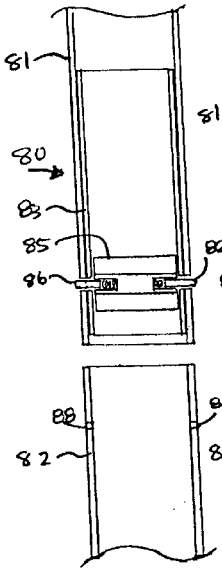
FIG. 5A, 5B and 5C are front cross-section views of component connection systems according to the present invention.
Figure 5B:
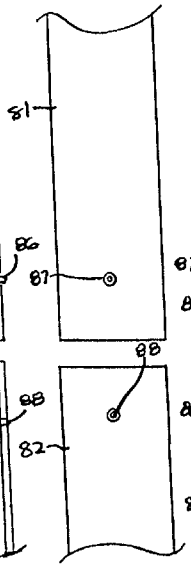
Figure 5C:
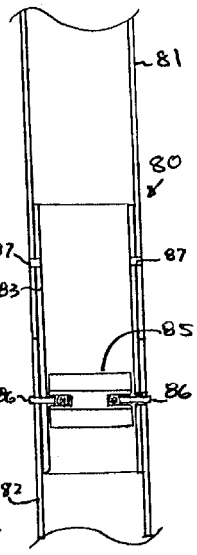

FIGS. 5A–5C show a pillar system 80 according to the present invention (usable with any building or structure herein) with an upper pillar 81 and a lower pillar 82 which are hollow cylinders like the pillars in FIG. 3A. A connecting sleeve 83 (shaped like the connecting member 63) is initially held up in the upper pillar 81 by a detent mechanism 85 having one, two, three, or more (at least one) spring-loaded detents 86 which initially and releasably project through holes 87 in the connecting sleeve 83 and holes 88 in the upper pillar 82.

Figure 6A:
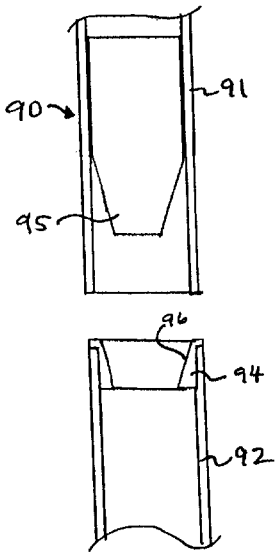
FIG. 6A and 6B are front cross-section views of component connection systems according to the present invention.
Figure 6B:
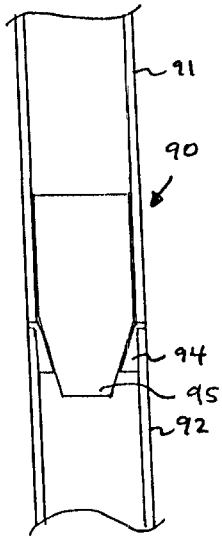

FIGS. 6A and 6B show a pillar system 90 according to the present invention with an upper pillar 91 and a lower pillar 92 (in one aspect, hollow cylinders like previously described pillars). A connecting member 93 is initially movably disposed in the upper pillar 91. The lower pillar 92 has a funnel member 94 emplaced on and/or secured to an upper end of the lower pillar 92. A tapered nose 95 of the connecting member 93 is sized and configured for reception in a tapered funnel portion 96 of the funnel member 94. Screws, bolts, glue or other fasteners or connectors may be used to secure the nose 95 to the lower pillar 92 and/or to the funnel member 94.

FIGS. 7A and 7B show a funnel member 94 with a lip 97. The lip or the entire funnel member may be made of shock absorbing material foam, plastic, seal material, metal, fiberglass composite, gasket material, or wood.

FIG. 8A and 8B show a funnel member 100 which is, in effect, a portion of the funnel member 94. One or more such funnel members 100 are used within a pillar to guide and hold a nose like the nose 95 or (as may be the case with the funnel member 94) to guide and hold a connecting member or sleeve which is small enough to enter between the funnel members (or into the full funnel).

FIGS. 9A and 9B show a building structure 110 according to the present invention with four pillars 112, each having an enlarged top opening 114 for facilitating receiving a pillar or other member of a building module, structure, deck, unit, etc. from above. An optional stop member 116 may be used on each pillar 112. Connecting members 118 interconnect the four pillars. In any such structure with four pillars only one, two, or three such pillars with enlarged top openings may be used and/or a pair of opposed pillars with enlarged top openings. Also, a structure with any number of pillars may have one or more pillars like those in FIG. 9A.

Figure 10A:
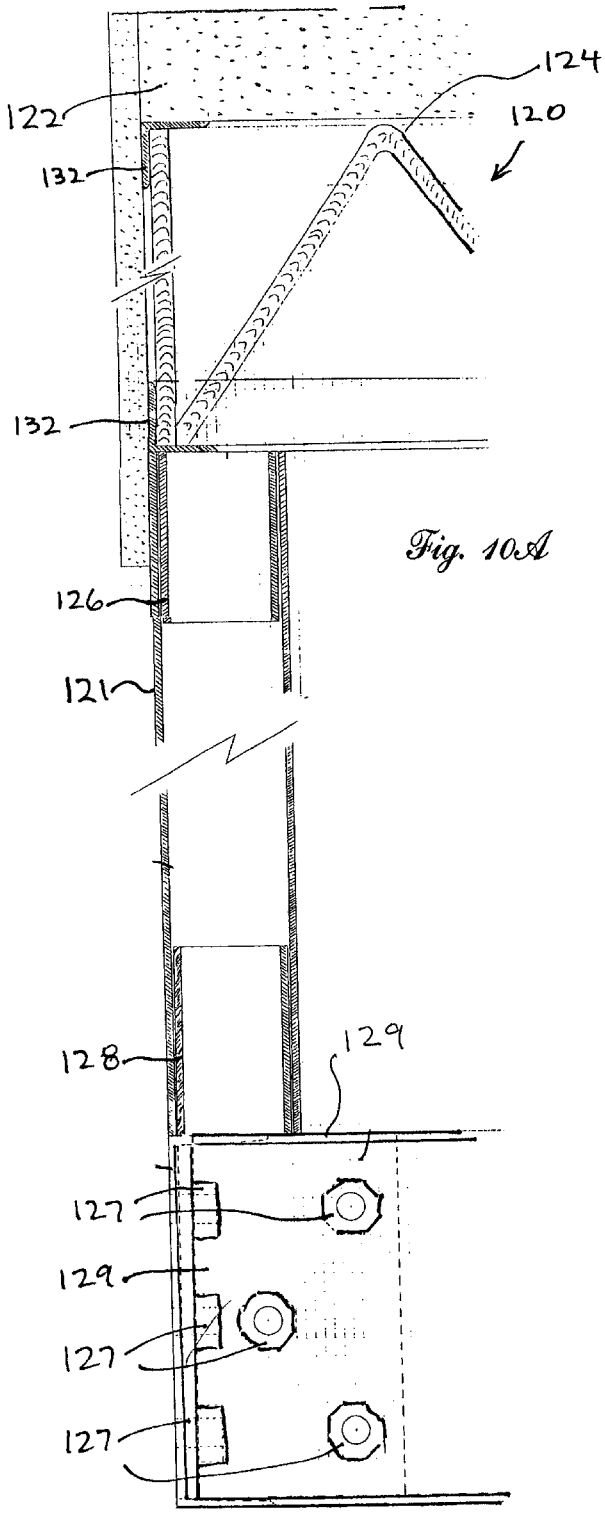
FIG. 10A is a side cross-section view of a building according to the present invention.
Figure 10B:
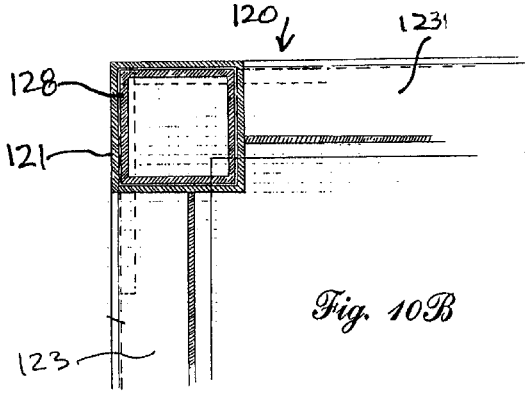
FIG. 10B is a top cross-section view of part of the building of FIG. 10A.
Figure 10C:
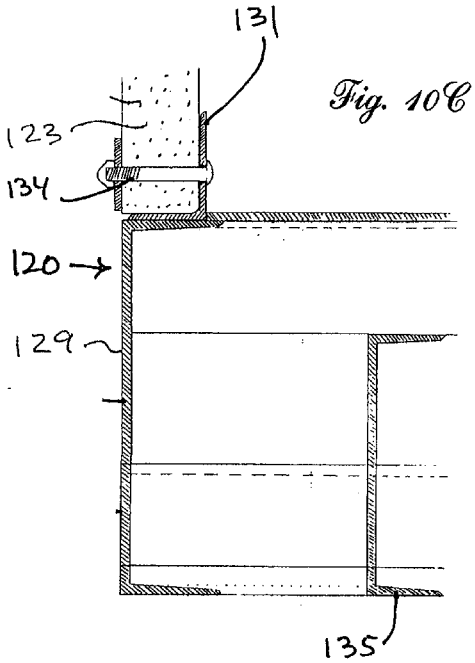
FIG. 10C is a side cross-section view of part of the building of FIG. 10A.

FIGS. 10A–10C show a building 120 (like the building 10 and with certain parts not shown as with the building 10) with a roof covering 122 made of any suitable material, including, but not limited to, spray-on plastic or roof membrane material. The roof covering 122 covers a roof truss 124 and a portion of the roof covering 122 projects down past the truss 124 and is adjacent an exterior surface of a pillar 121. In one aspect there are four pillars 121 with walls 123 between them (e.g., any wall disclosed herein) and, optionally, the roof covering projects down around the four walls 129.

L-shaped protectors 132 cover the edges of the truss 124 and completely surround it. A sub-pillar 126 secured to the truss 122 projects down into and is held within a hollow portion 123 of the pillar 121. A sub-pillar 128 is secured to a floor, foundation, or frame 129 and projects upwardly into and is held within the hollow pillar 121. Bolts 127 bolt together frame pieces. Such a pillar/sub-pillar mounting structure may be used with any building disclosed herein. Walls 123 are secured to mounting members 131 with bolts 134. The members 131 are secured to the frame 129, e.g., welded and/or bolted thereto. Support members 135 (one shown) are secured in the frame 129 and facilitate lifting and movement of the structure by mechanical equipment, e.g., but not limited to, by a forklift.

FIGS. 11A–11D show a covered roof truss 140 (like the truss 124 and roof covering 122, FIG. 10A) with covering 145 on a truss 149 mounted on a skid 142. The skid 142 (or floor or foundation) has hollow upwardly projecting members 144 that receive and hold downwardly projecting member 146 of the covered roof truss 140. The roof covering, which is optional, is sized to abut an upper surface 148 of the skid 142 to seal the truss/skid interface. Parts of a building 148 (including but not limited to one or more walls) and/or other items may be stored in a space 149 between the truss 140 and the skid 142. The members 144, 146 may be any desired shape and/or cross-section, including, but not limited to, tubular, triangular, square, rectangular, pentagonal or hexagonal. The members 146 may be solid or hollow. Conversely the members 146 may be hollow and be sized to receive the members 144.

Figure 11A:
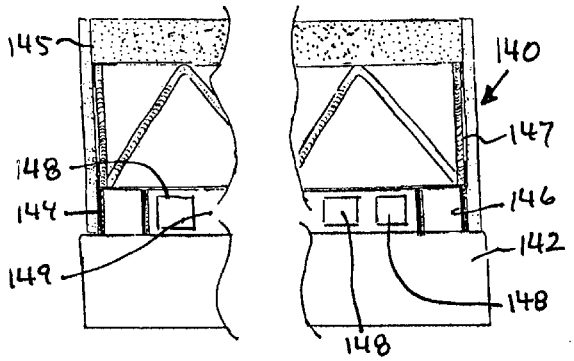
FIG. 11A is a side cross-section view of a roof truss and skid according to the present invention.
Figure 11B:
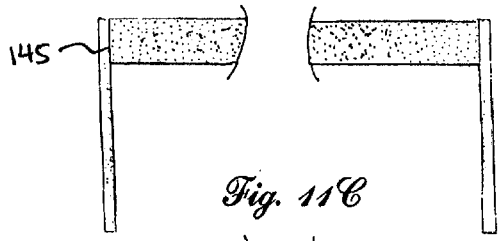
FIG. 11B–11D show parts of the structure of FIG. 11A.
Figure 11C:
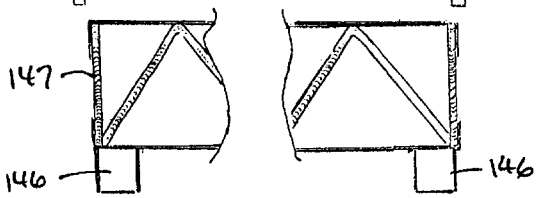
Figure 11D:
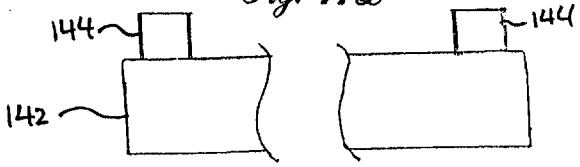
Figure 11E:
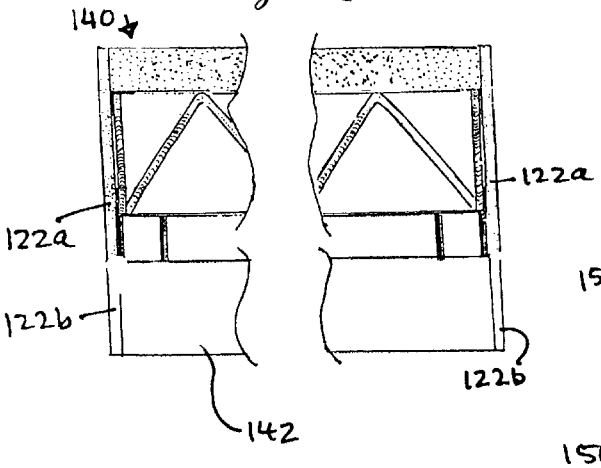
FIG. 11E presents an alternative embodiment of the structure of FIG. 11A.

FIG. 11E presents an alternative roof covering 122*a* for the structure 140. Lower ends 122*b* of the roof covering 122*a* encompass the skid 142 and seal against it.

Figure 12:
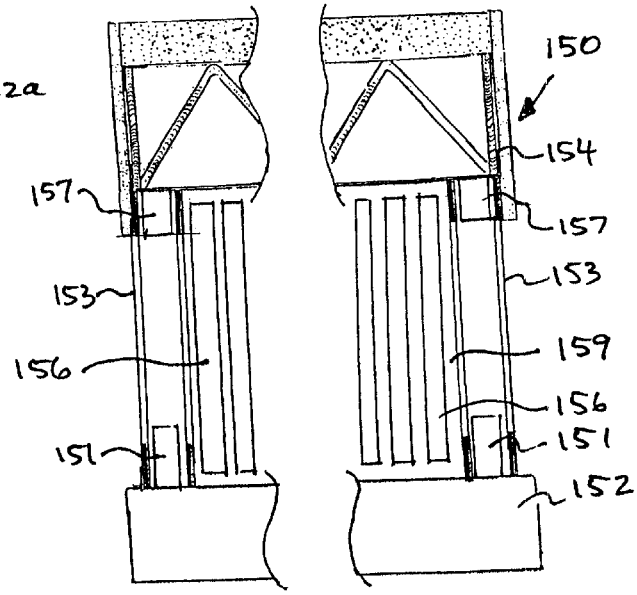
FIG. 12 is a side cross-section view of a roof truss and skid according to the present invention.

FIG. 12 shows a structure 150 like that of FIG. 11A, but with an enlarged space 159 between a roof truss 154 and a skid 152. The space 159 may be sized to hold some or all of the structural components and members 156 of a building (including, but not limited to walls of the building) to be assembled with the roof truss 124. The skid 152 may be, alternatively, a floor or foundation; or a skid itself may serve as a floor. Members 157 (like the members 146, FIG. 11C) project down into a hollow tubular 153 (the structure including one, two, three, four or more tubulars 153) and members 151 secured to the skid 152 project up into the tubulars 153.

Any building and/or truss/skid combination disclosed herein may be sized to be liftable by a crane or appropriate lifting device, and to have a minimal foot print when packaged on a skid for transport.

FIGS. 13A and 13B show a beam or header 200 according to the present invention which has a body 202 with a top step 204 and a bottom step 206 on or against which a wall, roof, floor or other structural component can rest. Optional tubular members 208, 210 are at either end of the beam 200 each with a channel 212, 214, respectively, therethrough from top to bottom. The tubular members 208, 210 can be formed of or secured to the body 202, e.g. by welding or with screws or bolts. The channel 212 is aligned with a channel 216 extending through the body 202 of the beam 200, as does a channel 218 which is aligned with the channel 214. Either or both channels 216, 218 may be eliminated. The channels provide a water drainage path from a roof or other structural component on the beam.

Figure 18:
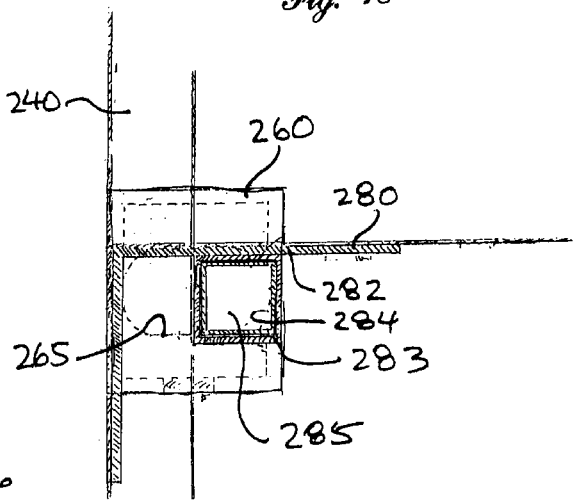
FIG. 18 is a top view of the components of FIG. 17.

Two blocks 220, 222 are secured to or formed integrally of the beam 200. In one particular aspect each of these blocks 220, 222 is shaped, sized and configured like a standard ISO fitting or corner for a standard ISO shipping container. FIG. 16B shows one embodiment I of such an ISO fitting 220 with lifting eyes E. Such a fitting with none or with only one or only two lifting eyes may also be used according to the present invention. Each block also has eyes or holes 221, 223, 225 (FIG. 16B) (see, e.g. also the eye 265 of a block 260, FIG. 18). Optionally a portion 228, 229 of each block projects away from the body 202 sufficiently so that a structure with blocks in corresponding locations can be positioned on top of a structure with the beam 200 with its blocks resting on the blocks 220, 222.

The beam 200 is, in certain aspects, well-suited for supporting a roof, e.g. but not limited to, a roof of a portable building. A beam 240 shown in FIGS. 14A and 14B is, in certain aspects, well-suited for supporting a floor, e.g., but not limited to, a floor of a portable building.

The beam 240 has a body 242 according to the present invention which has a top step 244 and a bottom step 246 on or against which a wall, roof, floor or other structural component can rest. Optional tubular members 248, 250 are at either end of the beam 240, each with a channel 252, 254, respectively, therethrough from top to bottom. The tubular members 248, 250 can be formed of or secured to the body 242, e.g. by welding or with screws or bolts.

The channel 252 is aligned with a channel 256 extending through the body 242 of the beam 240, as does a channel 258 which is aligned with the channel 254. Either or both channels 254, 258 may be eliminated. The channels provide a water drainage path through the beam 240.

Two blocks 260, 262 (e.g. like the fitting I, FIG. 16B) are secured to or formed integrally of the beam 240 and these blocks may, in certain aspects, be like the ISO corners described above with holes 261, 263, 265 (like the eyes 221, 223, 225), projecting portions 268, 269 (like the portions 228, 229, FIG. 13A).

FIG. 15 shows a structure 270 according to the present invention which includes a beam 200 as in FIG. 13A at the top and a beam 240 as in FIG. 14A at the bottom. Removable tubular supports 271, 272 each with a channel 273, 274, respectively, therethrough from top to bottom interconnect the beams 200, 240 and support the beam 200. As shown the tubular members 208, 210 of the beam 200 and the tubular members 248, 250 of the beam 240 are received within the tubular supports 251, 252. Alternatively, the ends of the tubular supports 251, 252 could be sized for reception with the tubular members 208, 210, 248, 250.

The intercommunicating and aligned channels 216, 212, 273, 252, and 256 provide a water drainage path from the top of the beam 200 to beneath the beam 240, as do the intercommunicating and aligned channels 218, 214, 272, 254, and 258.

Figure 16A:
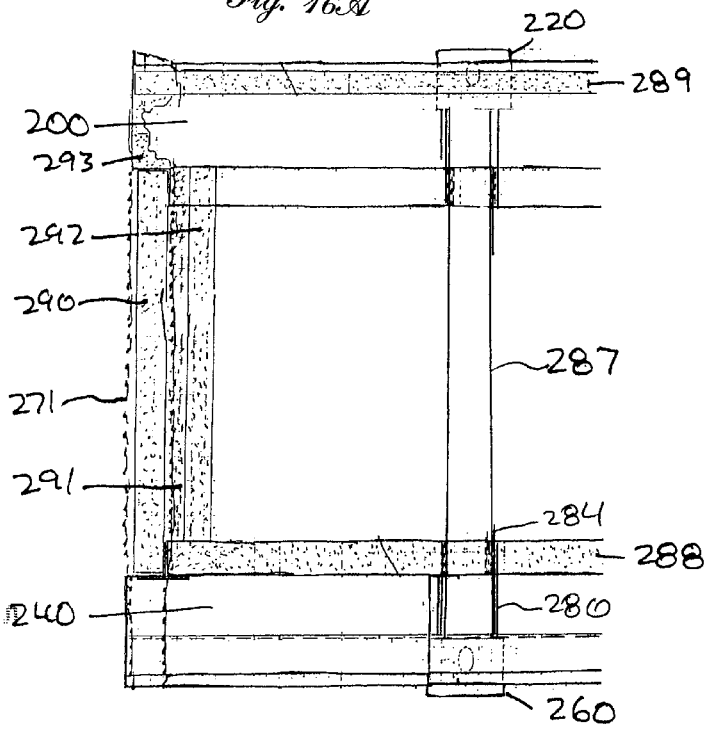
FIG. 16A is a cross-sectional front view of building components for a building according to the present invention.
Figure 16B:
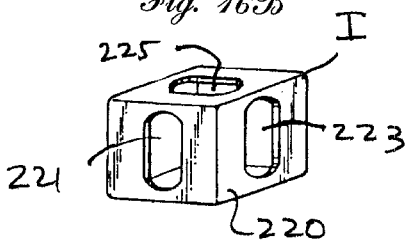
FIG. 16B is a perspective view of an ISO fitting of the building components of FIG. 16A.
Figure 17:
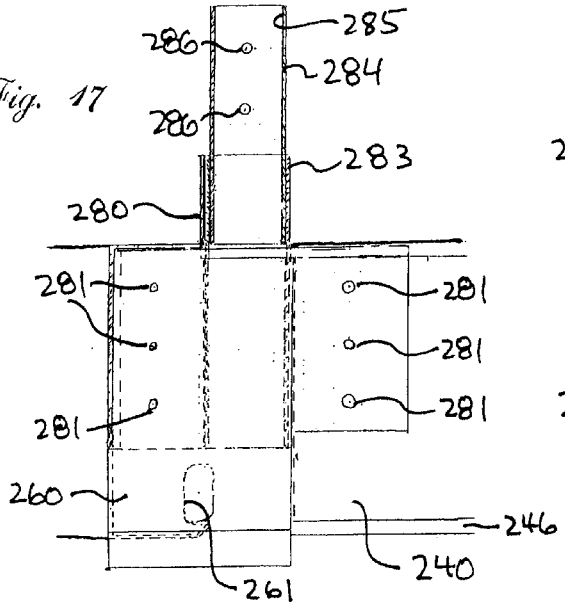
FIG. 17 is an enlargement of some of the components of FIG. 16.

FIG. 16A illustrates further components that may, within the scope of this invention, be provided between any two spaced apart blocks of any structure according to the present invention, e.g. but not limited to, as shown for the spaced-apart blocks 220 and 260 of the beams 200 and 240. A fitting 280 is secured to the beam 240 and may be bolted to the block 260. Bolts through holes 281 may be used to secure the fitting 280 to the beam 240 and/or it may e welded thereto. A hollow column 283 is formed integrally of or welded to a body 282 of the fitting 280. Secured within the column 283 is an end of a hollow tubular member 284 with an interior channel 285 therethrough from top to bottom and holes 286 for bolting a member received within the channel 285.

As shown in FIG. 16A, a tubular member 287 extends between the fitting 280 and an upper fitting 290 (like the fitting 280) on the block 220. A fitting like the fitting 280 or 290 can be provided for any block of any structure according to the present invention. (including, but not limited to, between blocks 222 and 272, FIGS. 13A and 14A). As shown in FIG. 16, the structure has a floor 288, a roof 289, a wall 290, an insulation layer 291, an interior wall 292, and a roof apron, lip or side piece 293. A combination of beams according to the present invention, like the beams 200 and 240 can be used at the ends of any structure, including but not limited to, at the ends of a portable building, including, but not limited to, for any building disclosed herein, including, but not limited to, any building according to the present invention, or for a side of any such structure or building. The tubular members 287 and/or the walls of the building may be load bearing members that support the roof and associated structure. Also, it is within the scope of this invention to provide side beams on one or both sides of a building, top and/or bottom, with one, two or more ISO fittings within the beam(s) like, e.g. the fittings or blocks 220, 222 (FIG. 13A).

Figure 19A:
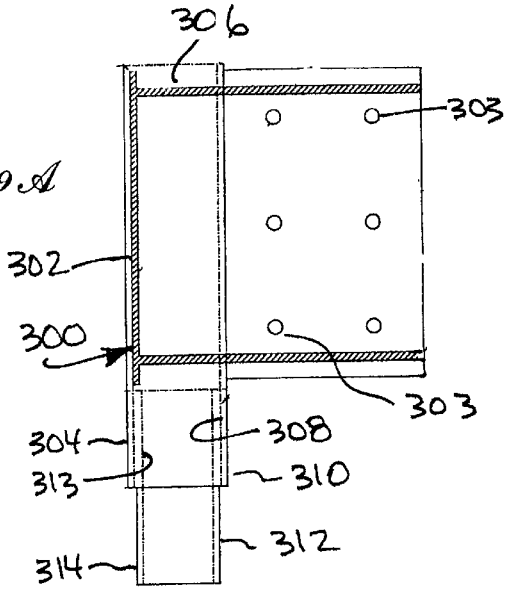
FIG. 19A is a side view of a corner fitting for a building according to the present invention.
Figure 19B:
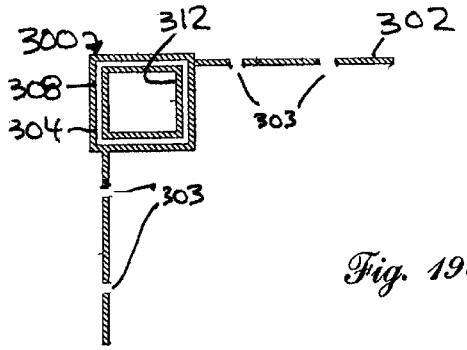
FIG. 19B is a top view of the fitting of FIG. 19A.

FIGS. 19A and 19B show a top corner fitting 300 according to the present invention which may be used with a beam or header according to the present invention, including, but not limited to, with a beam like the beam 200, FIG. 13A.

The fitting 300 has a body 302 with a plurality of holes 303 therethrough for securing the fitting 300 with bolts to a beam, and/or welding may be used for such securement. A hollow column 304 interconnected with the body 302 has an exposed top open end 306 and a channel 308 therethrough from top to bottom. A portion 310 of the column 304 projects down from the body 302. A tubular member 312 has an upper end 313 secured within the column 304 and a lower end 314 that projects down for receipt within or emplacement around a tubular support used with the fitting. A fitting 300 can replace, e.g., the tubular member 208, FIG. 13A.

Figure 20A:
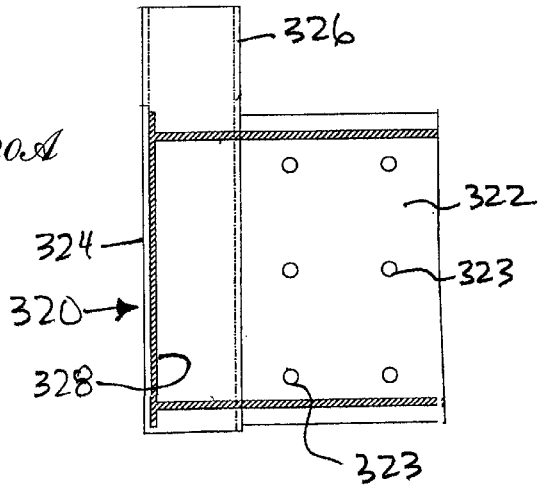
FIG. 20A is a side view of a corner fitting for a building according to the present invention.
Figure 20B:
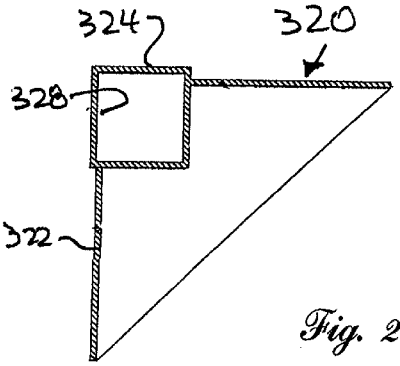
FIG. 20B is a top view of the fitting of FIG. 20A.

FIG. 20A shows a bottom corner fitting 320 according to the present invention which may be used with a beam or header according to the present invention, including, but not limited to, with a beam 240, FIG. 14A.

The fitting 320 has a body 322 with a plurality of holes 323 therethrough for securing the fitting 320 with bolts to a beam, and/or welding may be used for such securement. A hollow column 324 interconnected with the body 322 has a channel 328 therethrough from top to bottom and an upper end 326 that projects upwardly beyond the body 302. The upper end 326 can receive and hold an end of a tubular support member extending between two beams, or such a tubular support member's end can be emplaced around the end 326, encompassing it.

Figure 21A:
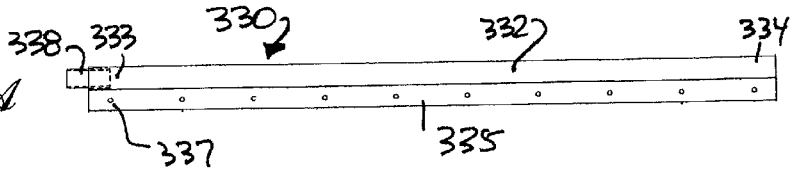
FIG. 21A is a side view of a support column for a building according to the present invention.
Figure 21B:
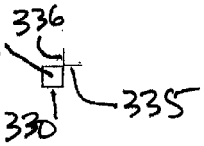
FIG. 21B is a cross-section view of the column of FIG. 21A.

FIGS. 21A and 21B show a support column 330 which may be used as a tubular support member for any structure herein. The column 330 has an optional channel 332 therethrough from top 333 to bottom 334. Arms 335, 336 formed integrally of the column 330 or secured thereto extend out from the column 330 and are positioned for attachment thereto of part of another structural component, e.g., but not limited to, a wall, a board, or a panel. Holes 337 may be used to effect such attachment. Optionally, a tubular member 338 may have one of its ends received and held within the end 333 of the column 330 and be inserted within a corresponding opening in another adjacent structural member.

Figure 22:
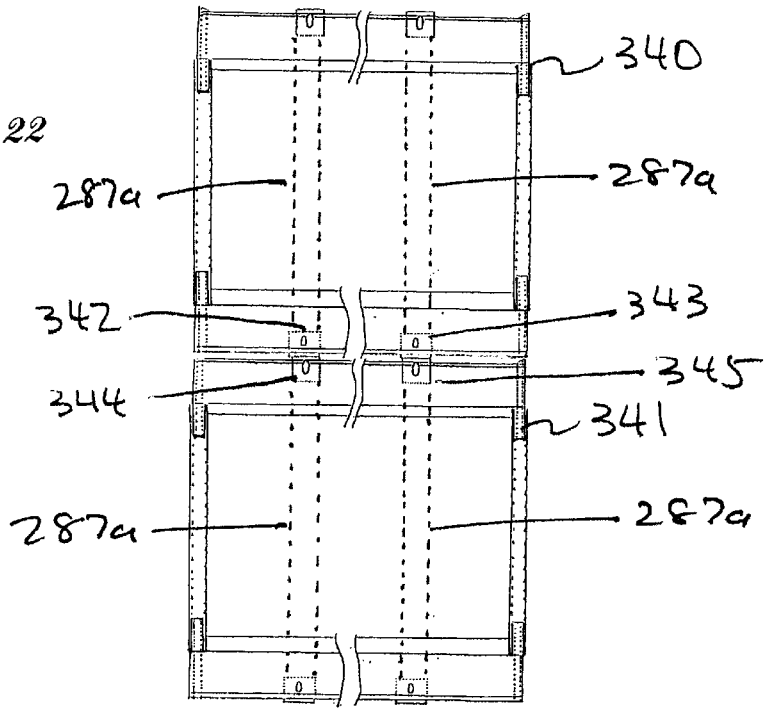
FIG. 22 is a front view of a structure according to the present invention.

FIG. 22 shows two structures 340, 341 (like the structure shown in FIG. 15) one on top of the other with blocks 342, 343 of the structure 340 (like the blocks 220, 222, FIG. 15) resting on blocks 344, 345 of the structure 341 (like the blocks 260, 252, FIG. 15). The blocks 344, 345 may be sized and positioned to act as load bearing members for the structure 340. Also, optional solid or tubular load bearing members 287a (shown in dotted line), e.g. like the tubular members 287 (FIG. 16A) may be used between each part of an upper and a lower block. Buildings as shown in FIG. 22 may also have side beams with integral ISO fittings (one, two, or more as described above) with or without load bearing members between pairs of upper and lower fittings.

It is within the scope of this invention to have a structure with two spaced-apart structures (like the structure 340) resting on a corresponding structure beneath which also has two spaced-apart structures (like the structure 340), i.e., with four blocks of the upper structure resting on four correspondingly-positioned blocks of the lower structure.

Figure 23A:
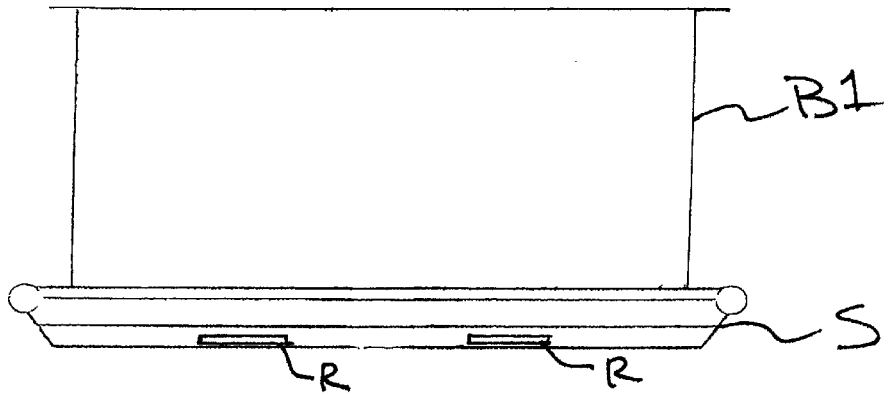
FIG. 23A and 23B are side schematic views of building according to the present invention.
Figure 23B:
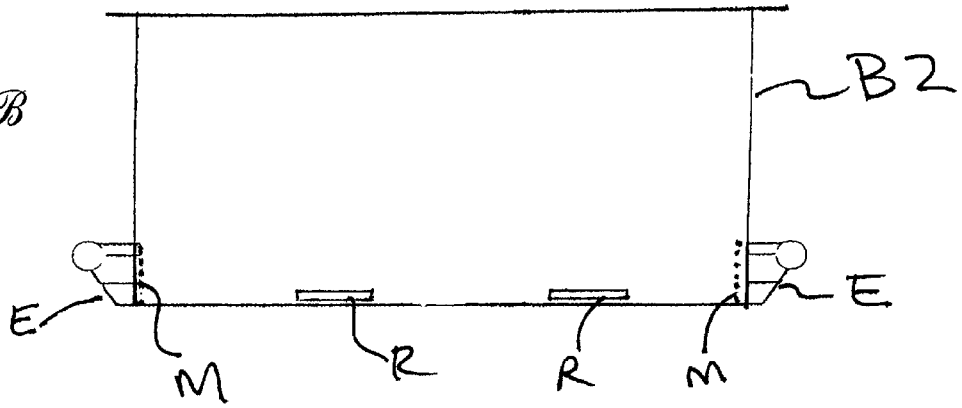

FIGS. 23A and 23B illustrate that buildings according to the present invention, including, but not limited to buildings as in FIGS. 13A–22, may be mounted on a skid S of suitable size and dimensions, e.g. as building B1 in FIG. 23A; or skid ends E of suitable length may be welded or bolted to suitable structural members, e.g. beams in FIG. 23B of building B2. Either the skid S (FIG. 23A) or side beams A (FIG. 23B), may have optional suitable openings or recesses R for receiving forks or shafts of a lifting machine, e.g. a forklift. Skid ends E may optionally, be mounted to the ends of upper beams, e.g. to the upper beams of the structures of FIGS. 15, 16A and 22.

The present invention, therefore, provides in certain if not all embodiments a portable building structure with a bottom section, a top section on the bottom section, the bottom section having at least one bottom support for supporting the top section, the at least one bottom support having a top opening, and the top section having at least one top support with a lower member projecting down into the top opening of the at least one bottom support. Such a building structure may have one, some (in any combination) or all of the following: wherein the at least one bottom support is a plurality of bottom supports that support the top section; a roof over the top section and secured thereto; a skid, the bottom section mounted on the skid; the skid with at least one upwardly projecting hollow skid support with a top opening, the bottom section has at least one downwardly projecting bottom member projecting into and held in the top opening of the at least one hollow skid member; wherein the at least one upwardly projecting hollow skid support is a plurality of hollow skid supports and the at least one downwardly projecting bottom member is a plurality of bottom members, one bottom member corresponding to each of the plurality of upwardly projecting hollow skid supports; at least one cross member extending within and from one interior side of the bottom section, the lower member of the at least one top support contacting the at least one cross-member; wherein the bottom section has an interior and the at least one cross member extends completely across the interior of the bottom section; wherein the at least one cross-member is a plurality of stop members; wherein the top opening of the bottom support has a funnel-shaped portion; at least one brace connected to both the top section and the bottom section; at least one brace connected to the roof and to the top section; the top section including a roof truss; a roof covering on the roof truss; and/or a floor extending across a lower portion of the top section.

The present invention, therefore, provides in certain if not all embodiments, a portable building structure with a bottom section, a top section on the bottom section, the bottom section having at least one bottom support for supporting the top section, the at least one bottom support having a top opening, and the top section having at least one top support with a lower member projecting down into the top opening of the at least one bottom support, wherein the at least one bottom support is a plurality of bottom supports that support the top section, a roof over the top section and secured thereto, a skid, the bottom section mounted on the skid, the skid has at least one upwardly projecting hollow skid support with a top opening, the bottom section has at least one downwardly projecting bottom member projecting into and held in the top opening of the at least one hollow skid member, wherein the at least one upwardly projecting hollow skid support is a plurality of hollow skid supports and the at least one downwardly projecting bottom member is a plurality of bottom members, one bottom member corresponding to each of the plurality of upwardly projecting hollow skid supports, the top section including a roof truss, a roof covering on the roof truss, and a floor extending across a lower portion of the top section.

The present invention, therefore, provides in certain if not all embodiments, a bottom section for a building structure, the bottom section having a plurality of support pillars interconnected by interconnection members, each support pillar of the plurality of support pillars having an enlarged top opening for receiving a lower member of an upper section to be emplaced on the bottom section.

The present invention, therefore, provides in certain if not all embodiments, a portable building structure with a bottom section, a top section on the bottom section, the bottom section having at least one bottom support for supporting the top section, the at least one bottom support having a top opening, the top section having at least one top support with a lower member projecting down into the top opening of the at least one bottom support, and a sub-pillar with a portion within the at least one bottom support and a portion within the at least one top support. Such a structure may have one, some (in any possible combination) or all of the following: at least one bolt securing the sub-pillar to at least one of the at least one bottom supports and at least one top support; at least one cross member extending within and from one interior side of the bottom section, the lower member of the at least one top support contacting the at least one cross-member; at least one releasable detent mechanism on the sub-pillar with a detent releasably extending through a hole in the at least one bottom support; a funnel member in the bottom section, the sub-pillar having a lower tapered end for receipt within the funnel member; a roof over the top section and secured thereto, a skid, the bottom section mounted on the skid, the top section including a roof truss, a roof covering on the roof truss, and a floor extending across a lower portion of the top section; and/or the skid has at least one upwardly projecting hollow skid support with a top opening, and the bottom section has at least one downwardly projecting bottom member projecting into and held in the top opening of the at least one hollow skid member.

The present invention, therefore, provides in certain if not all embodiments, a portable building structure with a roof truss with at least one roof truss support projecting downwardly therefrom, a skid with at least one skid support projecting upwardly therefrom, the roof truss on the skid, and a portion of one of the supports received within the other support. Such a structure may have one, some (in any possible combination) or all of the following: a roof covering on the roof truss, a lower portion of the roof covering sealingly contacting the skid; wherein the lower portion of the roof covering extends downwardly encompassing the skid; wherein the roof truss and the skid define a storage space therebetween; building components within the storage space for making a building with the roof truss; and/or wherein the building components include walls for the building.

Figure 24:
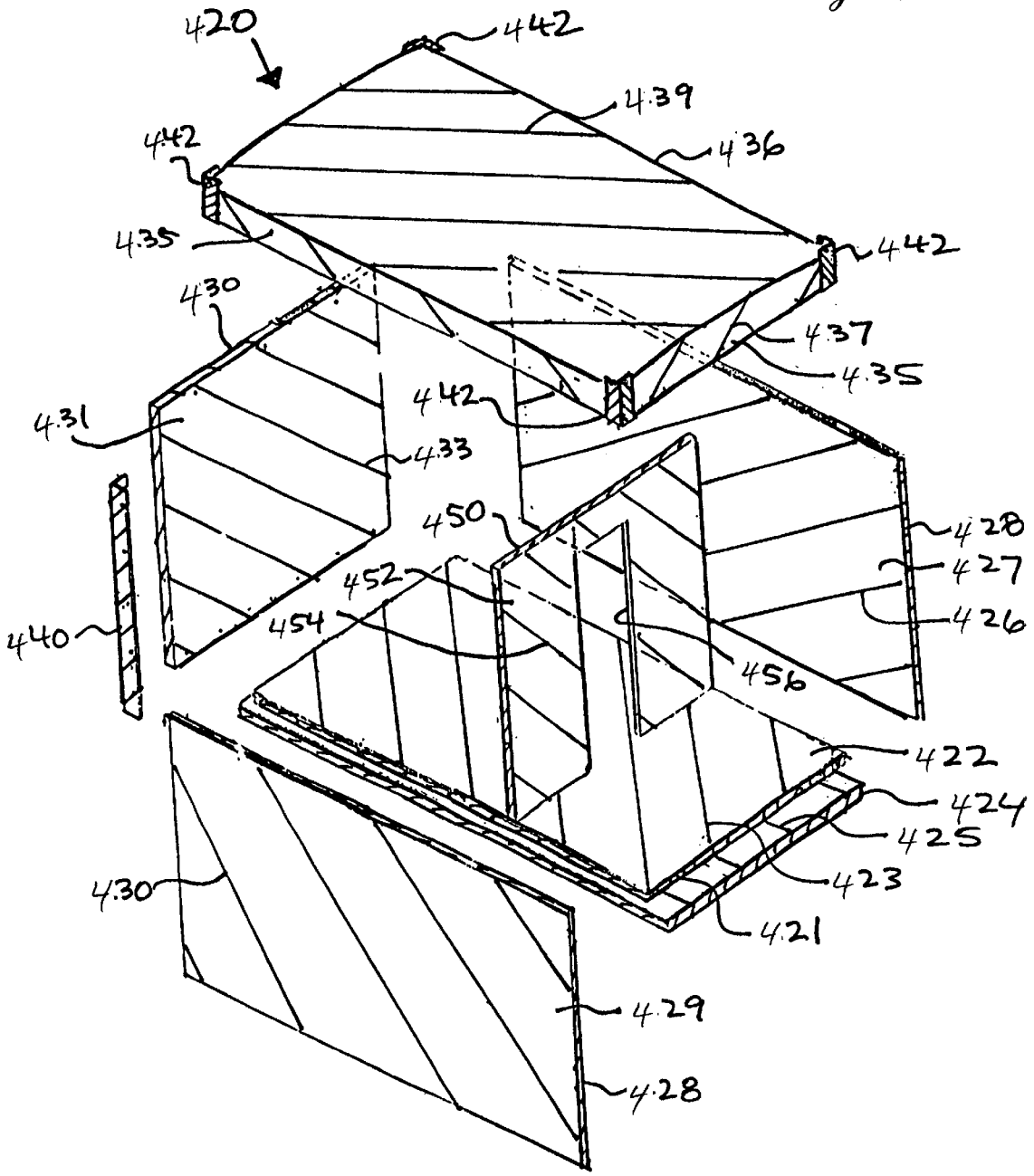
FIG. 24 is an exploded view of a building and components thereof according to the present invention.

FIG. 24 shows a building 420 (exploded view) according to the present invention which is like a prior art building except for covering material, which in one aspect is spray-on material on the components of the building. The cross-hatching on the various components indicates coating, e.g. a layer of coating or covering material, i.e., sprayed-on material, e.g., but not limited to, a layer of sprayed-on thermoplastic polyurea, sprayed-on thermoplastic polyurethane material, or sprayed-on thermoplastic polyurethane/polyurea. In one aspect the coating of such sprayed-on material is applied by known apparatus to a desired thickness, e.g. between about 1/16" to 3/8". A floor 422 rests on a support 424 (which can be any known skid, foundation, or support). The floor 422 has a coating 423 of covering material. Optionally an underside of the floor 422 is also coated with the covering material and/or edges 421 are similarly, optionally, coated as, optionally, are the edges of the other components of the building 420. The support 424 has a coating 425 of covering material. An underside surface of the support 424 may also be coated. An interior surface 427 of each side walls 428 is coated with coating 426 of covering material and, optionally, outside surfaces 429 may also be coated with a coating 430 of covering material. An interior surface 431 of an end wall 430 is coated with a coating 433 of covering material and, optionally, an exterior surface 432 is also coated with a coating 437 of covering material. A roof structure or truss 436 has a top coating or layer 439 of covering material and its sides 435 are also coated with a coating 437 of covering material. An underside of the roof truss 436 may also be coated with covering material. Alternatively, only exterior surfaces of the building 420 may be coated with covering material, prior to or following assembly. An end wall 450 with a door opening 456 has an exterior surface 452 with a coating 454 of covering material. The interior of the end wall 450 may also be coated with covering material.

Any part or component of the building 420 may be coated, covered, or layered partially or entirely, interiorly and/or exteriorly, with any coating, covering, or material disclosed herein.

In one aspect the building 420 is a portable building, movement of the building 420 is facilitated by its emplacement on the support 424. In one aspect wheels (not shown) on axles (not shown) may be mounted beneath the building with appropriate associated structure for transport of the building.

Sub-components of the building 420 may include any known structures and apparatus, e.g., but not limited to, galvanized corners 440 (one at each corner, one shown) and roof corners 442 may be coated exteriorly and/or interiorly, prior to or following building assembly. Any known gasket material and/or sealing material may be used to seal any interface between parts of the building 420.

Figure 25A:
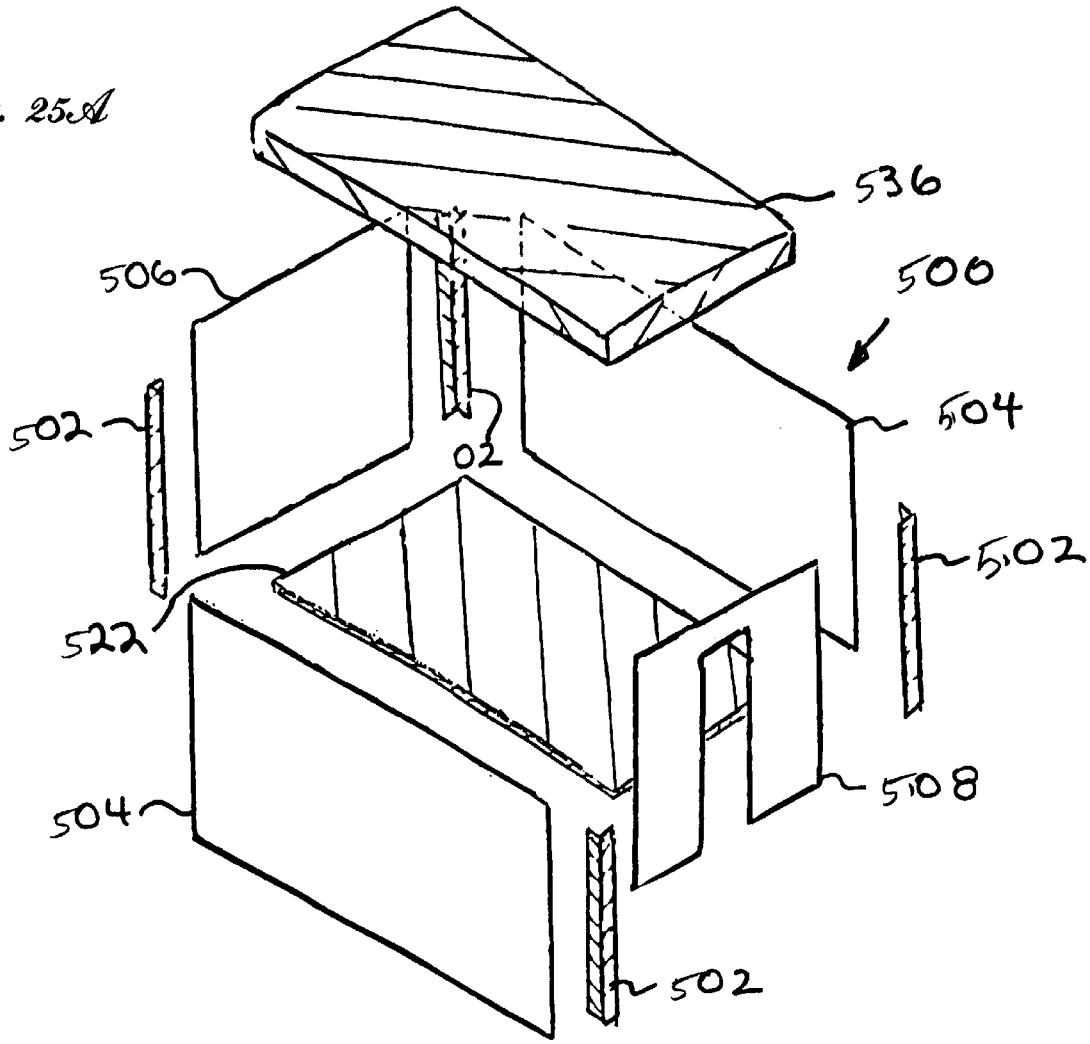
FIG. 25A is an exploded view of a building according to the present invention.
Figure 25B:
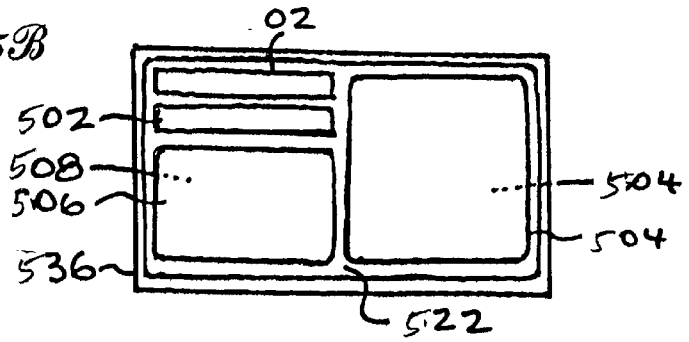
FIG. 25B is a top view of the roof of the building of FIG. 25A containing the building components.

FIGS. 25A and 25B show a building 500 according to the present invention with a floor 522 (like the floor 422) and a roof 536 (like the roof truss 436). The floor and roof may be coated with covering material as are the floor and roof of the building 420. Braces or pillars 502 are securable to the floor 522 to support the roof 536.

Side walls 504, an end wall 506, and an end wall 508 are "soft sided," i.e. they are non-rigid. In certain aspects these walls are made of flexible plastic sheet material, Nylon, blanket material, fiberglass blanket material, rubber sheets, canvass, or cloth. In other aspects these "soft sided" walls include one or more layers of the previously mentioned materials and one or more layers of insulation materials, including, but not limited to bubble wrap material, cellulose sheets or pads, and/or fiberglass insulation. In other aspects, these walls may be made of air inflatable parts or modules. In other aspects, supports or pillars, including but not limited to pillars such as the pillars 302 above, may be air inflatable structures or modules.

The walls may be secured, releasably or permanently, to the floor, braces and/or roof with suitable fasteners, grommets, glue, adhesive and/or Velcro™ material. Also or alternatively, the edges of adjacent walls may be fixed, releasably or permanently, to each other. Holes and/or transparent portions may be provided in any wall.

Figure 25C:
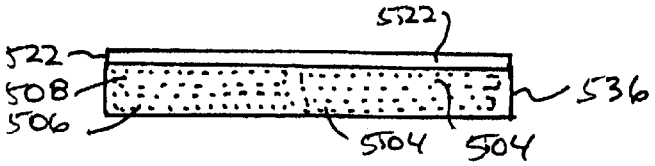
FIG. 25C is a side view of the roof and floor of a building as in FIG. 25A with the floor serving as a cover over the hollow roof.

FIG. 25B shows the components of the building 500 stored within the roof 536 (with the flexible walls folded to fit within the roof). The floor 522 is optional, or if properly sized, may serve as a cover over the roof opening as in FIG. 25C (instead of being sized to fit within the hollow roof as shown in FIG. 25B). The floor itself may be made of multiple parts.

Figure 25D:
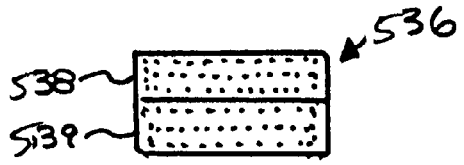
FIG. 25D is a side view of an alternative roof embodiment.

FIG. 25D shows an alternative embodiment of the roof 536 in which the roof comprises two hollow parts 538 and 539 which are either hingedly connected or stackable as shown. Building components within the roof parts are indicated by dotted lines.

Alternatively, one or more of the walls of the building 500 may be rigid and coated with covering material as described above. In one aspect the floor is rigid and hollow, the roof is soft-sided, and the building components are all storable within the floor. In one such aspect the top of the floor and all wall interiors are coated with covering material. Alternative a skid end may be welded or bolted to one or both building ends. Instead of the floor 522, the building may be mounted on any suitable skid. It is also within the scope of this invention for the roof and braces to support a second (third, and/or fourth or more) additional stories above the roof 536.

Figure 26:
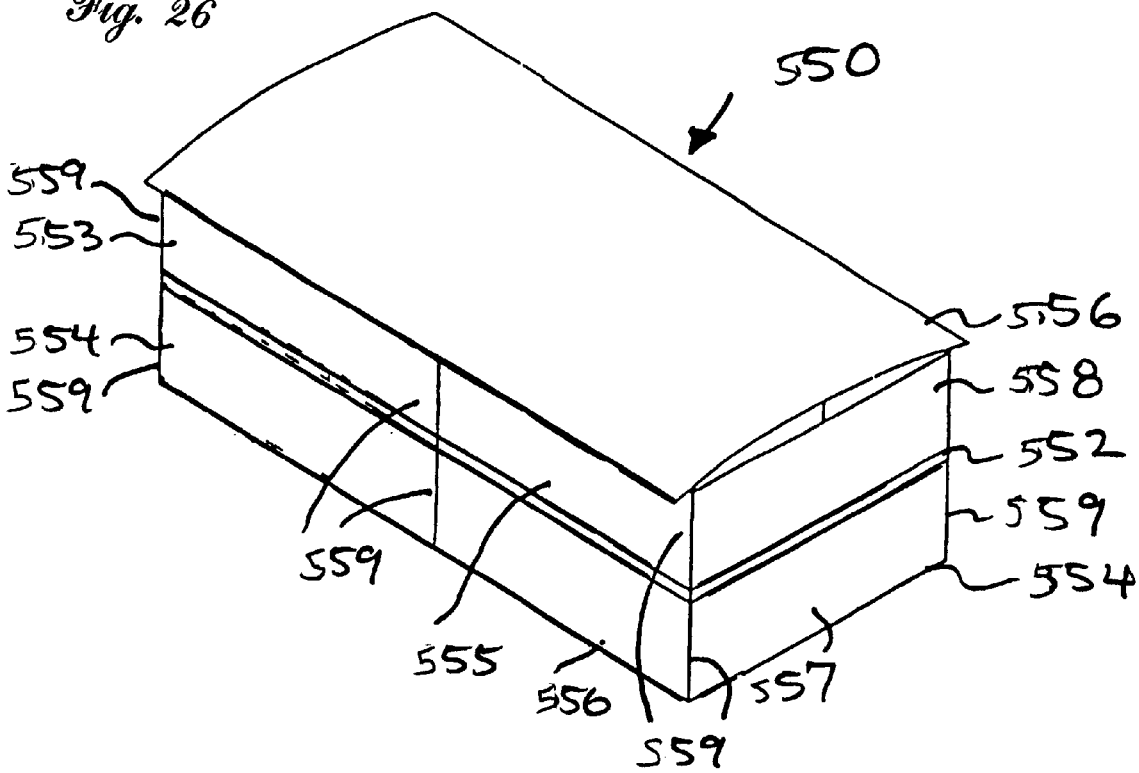
FIG. 26 is a perspective view of a building according to the present invention.

FIG. 26 shows a multi-story building 650 according to the present invention with a roof 656 (like the roof 636, FIG. 25A), an intermediate floor 552 (like the floor 522, FIG. 25A) and a floor 554 (like the floor 522, FIG. 25A; or a known skid). All of the walls 553, 554, 555, 556, 557, 558 (and walls not visible in the view of FIG. 26) are soft-sided as discussed above. Alternatively, one or some of these walls may be rigid. Frame elements 559 may be wood, steel, rigid plastic, air inflatable structures, and/or any suitable support material. Frame elements are used around the building as needed.

In one aspect the walls of the first story may be rigid and the walls of the second story are soft-sided, or vice-versa. Each story may be an individual module mountable on a story below and in certain aspects, supporting a story above.

A hollow roof 556 and a hollow floor 552 are combinable to form a storage/shipping container for all or the major part of the building's components. In another aspect a hollow roof is covered by the floor to form the container. Alternatively (as in FIG. 25D) either the roof 556 or the floor 552 or both may be made of stackable and/or connectible parts.

Buildings as the buildings 500 and 550 are easily transportable and, with appropriate component sizing, are helicopter-transportable. The roof and/or floors and/or walls of such buildings may be coated as previously described herein.

The present invention, therefore, provides in certain if not all embodiments, a beam for a portable building structure, the beam having a body with two spaced-apart ends, at least two blocks in the body, in one aspect of the size of standard ISO corner fittings, each block with at least one eye therein for lifting, each of the at least two blocks spaced-apart from each other and spaced-apart from the two spaced-apart ends of the body. Such a beam with one, some (in any possible combination) or all of the following: at least one water drainage channel through the beam from top to bottom; wherein said channel is located at an end of the beam; wherein the at least one water drainage channel is a first water drainage channel in one end of the beam and a second water drainage channel in the other end of the beam; and/or a tubular support member on and projecting from each block.

The present invention, therefore, provides in certain if not all embodiments, a structure comprising a first structure with a first beam and a second beam, each beam with a body with two spaced-apart ends, at least two blocks in the body of the size of standard ISO corner fittings, each of the at least two blocks spaced-apart from each other and spaced-apart from the two spaced-apart ends of the body, the blocks of the first beam aligned with the blocks of the second beam forming pairs of upper and lower blocking, each beam having a tubular support on and projecting from each block, a tubular member extending between the tubular supports of each pair of upper and lower blocks, each tubular member having two ends with an upper end projecting into the tubular support corresponding to an upper block and a lower end projecting into the tubular support corresponding to a lower block. Such a structure may have one, some (in any possible combination) any or all of the following: a structure with a third beam and a fourth beam, each of the third and fourth beams with a body with two spaced-apart ends, at least two blocks in the body of the size of standard ISO corner fittings, each of the at least two blocks spaced-apart from each other and spaced-apart from the two spaced-apart ends of the body, the blocks of the first beam aligned with the blocks of the second beam forming pairs of upper and lower blocking, each beam of the third and fourth beams having a tubular support on and projecting from each block, a tubular member extending between the tubular supports of each pair of upper and lower blocks, each tubular member having two ends with an upper end projecting into the tubular support corresponding to an upper block and a lower end projecting into the tubular support corresponding to a lower block, the first beam and third beams spaced-apart from each other and disposed above and apart from the second beam and fourth beams, the second and fourth beams spaced-apart from each other, a roof on the first and third beams, and a floor on the second and fourth beams; a plurality of walls encompassing a space between the roof and floor; wherein the roof, walls and floor are secured to the beams without welding; the roof and the floor interconnected and spaced-apart by a plurality of removable support members, an inner surface of the roof and an inner surface of the floor defining a storage space therebetween; a plurality of building components in the storage space for converting the structure into a building; wherein the plurality of building components includes a plurality of wall support columns and of walls for encompassing and walling off the storage space; the plurality of building components further comprising at least one door and at least one window for the building; wherein the walls are soft-sided flexible material; wherein the roof has at least one roof water drainage channel therethrough, at least one of the removable support members has a support water drainage channel therethrough, and the floor has at least one floor water drainage channel therethrough, the at least one water, support, and floor water drainage channels aligned to drain water from the roof; wherein the at least one roof, floor and support water drainage channels are a plurality of each so that there are multiple water drains from the roof; the first and third beams interconnected by a pair of spaced-apart roof side beams, and the second and fourth beams interconnected by a pair of spaced-apart floor beams; at least two roof blocks in each of the pair of spaced-apart roof side beams, each of said blocks of the size of standard ISO corner fittings, each block with at least one eye therein for lifting, and at least two floor blocks in each of the pair of spaced-apart floor beams, each of said blocks of the size of standard ISO corner fittings, each block with at least one eye therein for lifting; and/or at least one of the floor beams having recesses suitable for receiving and holding forks of a fork lift machine. In one particular aspect there are two such structures one on top of the other with the floor blocks of one (or at least two floor blocks of one) resting on corresponding roof blocks of the other.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A beam for a portable building structure, the beam comprising a body with two spaced-apart ends, at least two blocks in the body of the size of standard ISO corner fittings, each block with at least one eye therein for lifting, each of the at least two blocks spaced-apart from each other and spaced-apart from the two spaced-apart ends of the body, and a tubular support member on and projecting from each block.

2. The beam of claim 1 further comprising at least one water drainage channel through the beam from top to bottom.

3. The beam of claim 2 wherein the at least one water drainage channel is located at an end of the beam.

4. The beam of claim 1 wherein each of the at least two blocks is of the size of a standard ISO corner fitting.

5. A structure comprising a first structure with a first beam and a second beam, each beam comprising a body with two spaced-apart ends, at least two blocks each with at least one lifting eye, each of the at least two blocks spaced-apart from each other and spaced-apart from the two spaced-apart ends of the body, the blocks of the first beam aligned with the blocks of the second beam forming pairs of upper and lower blocking, each beam having a tubular support on and projecting from each block, a tubular member extending between the tubular supports of each pair of upper and lower blocks, each tubular member having two ends with an upper end projecting into the tubular support corresponding to an upper block and a lower end projecting into the tubular support corresponding to a lower block.

6. The structure of claim 5 further comprising a second structure with a third beam and a fourth beam, each of the third and fourth beams comprising a body with two spaced-apart ends, at least two blocks in the body of the size of standard ISO corner fittings, each of the at least two blocks spaced-apart from each other and spaced-apart from the two spaced-apart ends of the body, the blocks of the third beam aligned with the blocks of the fourth beam forming pairs of upper and lower blocking, each beam of the third and fourth beams having a tubular support on and projecting from each block, a tubular member extending between the tubular supports of each pair of upper and lower blocks, each tubular member having two ends with an upper end projecting into the tubular support corresponding to an upper block and a lower end projecting into the tubular support corresponding to a lower block, the first beam and third beams spaced-apart from each other and disposed above and apart from the second beam and fourth beams, the second and fourth beams spaced-apart from each other, a roof on the first and third beams, and a floor on the second and fourth beams.

7. The structure of claim 6 further comprising a plurality of walls encompassing a space between the roof and floor.

8. The structure of claim 6 wherein the roof, walls and floor are secured to the beams without welding.

9. The structure of claim 6 further comprising the roof and the floor interconnected and spaced-apart by a plurality of removable support members, an inner surface of the roof and an inner surface of the floor defining a storage space therebetween.

10. The structure of claim 9 further comprising a plurality of building components in the storage space for converting the structure into a building.

11. The structure of claim 10 wherein the plurality of building components includes a plurality of wall support columns and of walls for encompassing and walling off the storage space.

12. The structure of claim 11 further comprising the plurality of building components further comprising at least one door and at least one window for the building.

13. The structure of claim 11 wherein the walls are soft-sided flexible material.

14. The structure of claim 9 wherein the roof has at least one roof water drainage channel therethrough, at least one of the removable support members has a support water drainage channel therethrough, and the floor has at least one floor water drainage channel therethrough, the at least one water, support, and floor water drainage channels aligned to drain water from the roof.

15. The structure of claim 14 wherein the at least one roof, floor and support water drainage channels are a plurality of each so that there are multiple water drains from the roof.

16. The structure of claim 6 further comprising the first and third beams interconnected by a pair of spaced-apart roof side beams, and the second and fourth beams interconnected by a pair of spaced-apart floor beams.

17. The structure of claim 16 further comprising at least two roof blocks in each of the pair of spaced-apart roof side beams, each of said roof blocks with at least one eye therein for lifting, and at least two floor blocks in each of the pair of spaced-apart floor beams, each of said floor blocks with at least one lifting eye.

18. The structure of claim 17 further comprising at least one of the floor beams having recesses suitable for receiving and holding forks of a fork lift machine.

19. Two structures each comprising a first structure and a second structure as in claim 17, one on top of the other with the floor blocks of one resting on the roof blocks of the other.

* * * * *